US006833169B2

(12) United States Patent
Kasperchik et al.

(10) Patent No.: US 6,833,169 B2
(45) Date of Patent: Dec. 21, 2004

(54) POROUS INK-JET PRINTED MEDIA SEALED BY INTERPOLYMER COMPLEX

(75) Inventors: Vladek P Kasperchik, Corvallis, OR (US); Gary Allan Ungefug, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/267,233

(22) Filed: Oct. 8, 2002

(65) Prior Publication Data

US 2004/0066439 A1 Apr. 8, 2004

(51) Int. Cl.[7] ..... B41M 5/00
(52) U.S. Cl. ..... 428/32.24; 428/32.36
(58) Field of Search ..... 428/32.24, 32.36

(56) References Cited

U.S. PATENT DOCUMENTS

| | | | | |
|---|---|---|---|---|
| 5,448,273 A | | 9/1995 | Klein et al. | |
| 5,474,843 A | | 12/1995 | Lambert et al. | |
| 5,500,457 A | | 3/1996 | Sarkar et al. | |
| 6,010,590 A | | 1/2000 | Cherkas | |
| 6,194,075 B1 | | 2/2001 | Sargeant et al. | |
| 6,268,101 B1 | | 7/2001 | Yacobucci et al. | |
| 6,412,935 B1 | | 7/2002 | Doumaux | |
| 6,457,834 B1 | * | 10/2002 | Cotton et al. | 353/122 |
| 6,475,603 B1 | * | 11/2002 | Wexler | 428/32.25 |

FOREIGN PATENT DOCUMENTS

| | | |
|---|---|---|
| EP | 0685344 A2 | 12/1995 |
| EP | 1008457 A1 | 6/2000 |
| EP | 1127709 A1 | 8/2001 |
| WO | WO02/072359 | 9/2002 |

* cited by examiner

*Primary Examiner*—Bruce H. Hess

(57) ABSTRACT

A media sheet which can be used with a new system and method of the present invention is provided. Specifically, a media sheet can comprise a substrate, a porous dye-receiving layer deposited on the substrate, and a porous ionic layer deposited on the porous dye-receiving layer. Thus, when the ink-jet ink is printed onto the media sheet, ink-jet ink passes substantially through the porous ionic layer and onto the porous dye-receiving layer forming an ink-jet ink-containing media sheet. A fluid sealant composition having an opposite polarity than the ionically-charged surfaces can then be applied. Upon application of the fluid sealant to the ink-jet ink-containing media sheet, an interpolymer complex is formed sealing the ink-jet ink in the media sheet.

48 Claims, 2 Drawing Sheets

POROUS INK-JET PRINTED MEDIA SEALED BY INTERPOLYMER COMPLEX

FIELD OF THE INVENTION

The present invention is drawn to ink-jet ink media, systems, and methods for reducing air fade of ink-jet produced images. In one detailed aspect, the present invention is drawn to the preparation of interpolymer complexes for the sealing of ink-jet produced images on porous media.

BACKGROUND OF THE INVENTION

Computer printing technology has evolved to a point where very high resolution images can be prepared on various types of media. This has been, in part, why inkjet printing has become a popular way of recording images on various media, particularly paper. Other reasons include low noise, capability of high speed recording, and multi-color recording. Additionally, these advantages can be obtained at a relatively low price to consumers. Though there has been great improvement in ink-jet printing, accompanying this improvement are increased demands on ink-jet printing, e.g., higher speed, higher resolution, full color image formation, image permanence, etc.

There are several characteristics to consider when evaluating a printer ink in conjunction with a printing surface or substrate. Such characteristics include edge acuity and optical density of the image on the surface, dry time of the ink on the substrate, adhesion to the substrate, lack of deviation of ink droplets, presence of all dots, resistance of the ink after drying to water and other solvents, long-term storage stability, and long-term reliability without corrosion or nozzle clogging. In addition to these characteristics, when printing on inorganic porous media substrates, light fade and air fade resistance is also an issue for consideration. Though the above list of characteristics provides a worthy goal to achieve, there are difficulties associated with satisfying all of the above characteristics. Often, the inclusion of an ink component meant to satisfy one of the above characteristics can prevent another characteristic from being met. Thus, most commercial inks for use in ink-jet printers represent a compromise in an attempt to achieve at least an adequate response in meeting all of the above listed requirements.

Papers used for ink-jet printing have typically included high-quality or wood-free papers designed to have a high ink absorptivity. These papers are functionally good for ink-jet printing because the ink-jet inks may be absorbed readily and dry quickly. However, such papers often do not allow for a crisp or sharp image.

In order to attain enhanced print quality and image quality as in a photograph, special media has been developed to work with aqueous inks. For example, various coated papers have been prepared for use with ink-jet printing technology. Existing ink-jet media used in digital imaging can be separated into two broad groups: porous media and swellable media.

With porous media, an ink receiving layer can comprise a porous inorganic oxide (usually silica or alumina) bound together by some polymer binder, and optionally, mordants or ionic binding species, e.g., cationic binding species for use with anionic dyes or anionic binding species for use with cationic dyes. During printing, ink is quickly absorbed by the physical porosity of the media, and if an ionic binding species is present, the dye is attracted to the ionic species of opposite charge. In other words, the colorant (typically a dye) can be bound either by mordants incorporated into porous layer, or by the inorganic oxide surface itself. This type of media has the advantage of relatively short dry-times, good smearfastness, and often, acceptable water and humidity resistance. However, porous media often exhibits poor fade resistance (both in light and dark conditions), and sometimes exhibits poor water and humidity resistance.

Conversely, with swellable media, an ink receiving layer is present that comprises a continuous layer of a swellable polymer that is not physically porous. Upon printing, ink is absorbed as water contacts and swells the polymer matrix. The colorant (typically a dye) can be immobilized inside the continuous layer of the polymer with significantly limited exposure to the outside environment. Advantages of this approach include much better fade resistance (in both light and dark conditions) than is present with porous media. However, swellable media requires a longer dry time and exhibits poor smearfastness.

Though both swellable media and porous media each provide unique advantages in the area of ink-jet printing, new media and a system for printing images that provide advantages from both systems while minimizing their respective disadvantages would be an advancement in the art.

SUMMARY OF THE INVENTION

It has been recognized that it would be advantageous to develop ink-jet ink media, systems, and methods that provide the advantages of both porous media and swellable media. Specifically, the present invention provides a media sheet, comprising a substrate, a porous dye-receiving layer deposited on the substrate, and a porous ionic layer deposited on the porous dye-receiving layer. The porous dye-receiving layer can comprise a metal or semi-metal oxide bound by a polymeric binder. The porous ionic layer can comprise particulates having ionically-charged surfaces.

The media sheet can include other added materials, including an ink-jet ink deposited on the porous ionic layer, wherein the ink-jet ink comprises an ink vehicle and a dye. The dye can have the same polarity as the ionically-charged surfaces, and the ink vehicle can be substantially free of components that would substantially react with the ionically-charged surfaces. In an alternative embodiment, a fluid sealant composition can be deposited on the porous ionic layer forming an interpolymer complex. Such a fluid sealant composition can comprise a substantially uncrosslinked water soluble or dispersible polymer having an opposite polarity than the ionically-charged surfaces.

In accordance with an alternative detailed aspect of the present invention, a system of generating ink-jet images can comprise a properly configured media sheet, an ink-jet ink, and a fluid sealant composition. The media sheet can comprise a substrate, a porous dye-receiving layer deposited on the substrate, and a porous ionic layer deposited on the porous dye-receiving layer. The porous dye-receiving layer can comprise a metal or semi-metal oxide bound by a polymeric binder, and the porous ionic layer can comprise particulates having ionically-charged surfaces or can comprise ionically-charged water-soluble polymers. The ink-jet ink can comprise an ink vehicle and a dye, wherein the dye has the same polarity as the ionically-charged species in the porous ionic layer, and the ink vehicle is substantially free of components that would substantially react with the ionically-charged surfaces or species in the porous ionic layer. Thus, when the ink-jet ink is printed onto the media sheet, the inkjet ink passes through the porous ionic layer and is deposited on the porous dye-receiving layer forming an ink-jet ink-containing media sheet. A fluid sealant composition can then be deposited that comprises a substantially uncrosslinked water soluble or dispersible polymer having an opposite polarity compared to the ionically-charged surfaces. Upon deposition of the fluid sealant to the ink-jet ink-containing media sheet, an interpolymer complex can be formed, sealing the ink-jet ink in the media sheet.

In another aspect of the present invention, a method of ink-jet recording can comprise the steps of providing an appropriately configured media sheet, ink-jet printing an appropriately configured ink-jet ink onto the media sheet, and sealing the ink-jet ink in the media sheet with an appropriately configured fluid sealant composition. The media sheet can comprise a substrate, a porous dye-receiving layer deposited on the substrate, and a porous ionic layer deposited on the porous dye-receiving layer. The porous dye-receiving layer can comprise a metal or semi-metal oxide bound by a polymeric binder, and the porous ionic layer can comprise particulates having ionically-charged surfaces. The ink-jet ink can comprise an ink vehicle and a dye, wherein the dye has the same polarity as the ionically-charged surfaces, and the ink vehicle is substantially free of components that would substantially react with the ionically-charged surfaces. With this combination or configuration, the media sheet can accept the ink-jet ink without substantial reaction at the porous ionic layer, thereby forming an ink-jet ink-containing media sheet. The sealing step can occur using a fluid sealant composition comprising a substantially uncrosslinked water soluble or dispersible polymer having an opposite polarity as the ionically-charged surfaces. Upon application of the fluid sealant to the ink-jet ink-containing media sheet, an interpolymer complex can be formed that seals the ink-jet ink in the media sheet.

Additional features and advantages of the invention will be apparent from the detailed description which follows, taken in conjunction with the accompanying drawings, which together illustrate, by way of example, features of the invention.

DETAILED DESCRIPTION OF THE PREFERRED EMBODIMENT(S)

Figure 1:
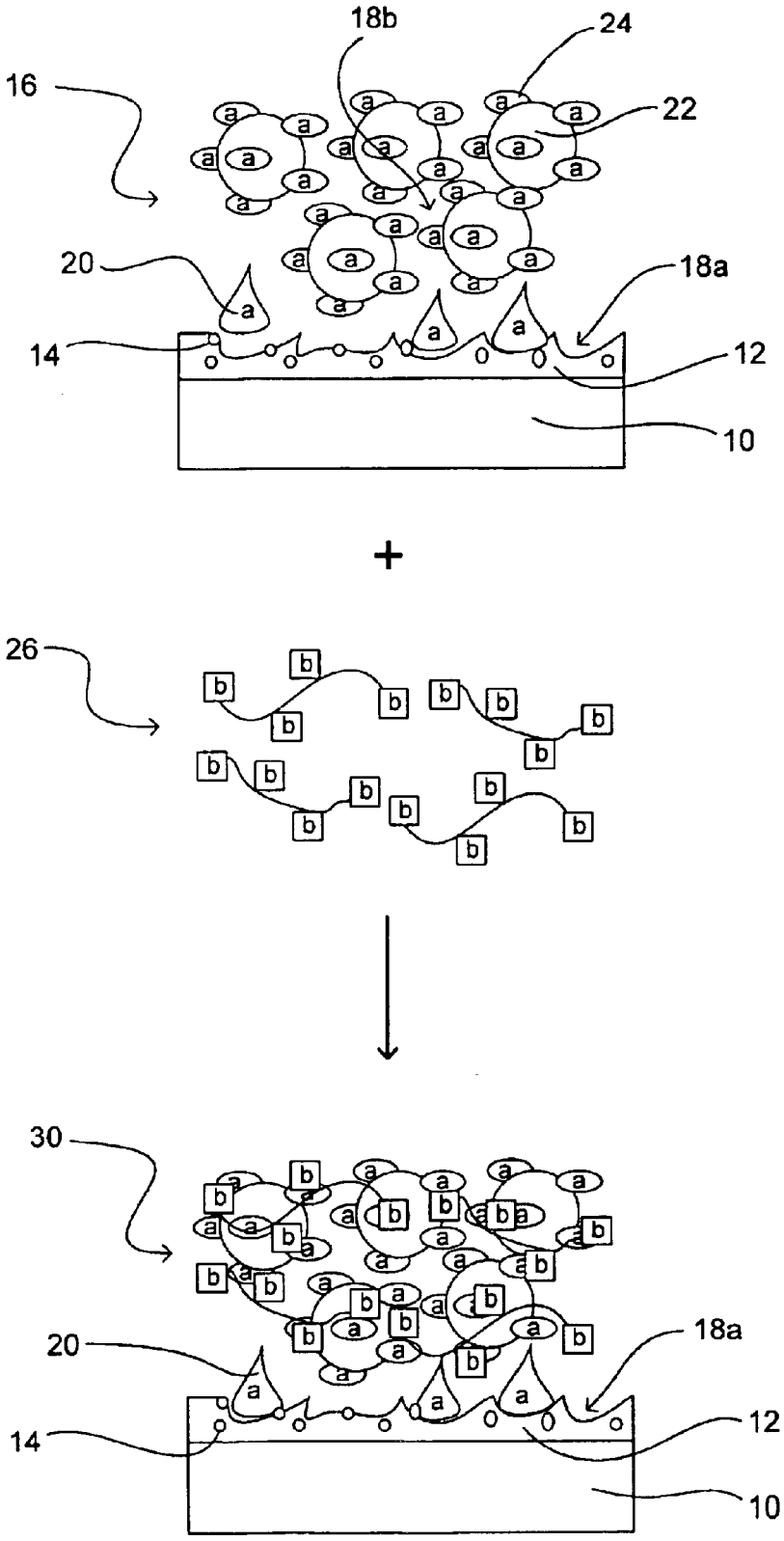
FIG. 1 provides a representational view of a system in accordance with an embodiment of the present invention.

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It must be noted that, as used in this specification and the appended claims, the singular forms "a," "an," and "the" include plural referents unless the content clearly dictates otherwise.

As used herein, "effective amount" refers to the minimal amount of a substance or agent, which is sufficient to achieve a desire effect. For example, an effective amount of an "ink vehicle" is the minimum amount required in order to create ink, which will meet functional performance and characteristic standards.

As used herein, "ink vehicle," refers to a vehicle in which the dyes used in accordance with the present invention are incorporated in the form of an ink-jet ink. Ink vehicles are well known in the art, and a wide variety of ink vehicles may be used with the ink composition of the present invention. Such ink vehicles may include a mixture of a variety of different agents, including without limitation, surfactants, solvents, cosolvents, buffers, biocides, viscosity modifiers, surface- active agents, and water. Typically, the ink vehicle can be substantially free of any components that are reactive with the porous ionic layer of the media, systems, and/or methods of the present invention.

"Porous media" refers to any substantially inorganic composition-coated media having surface voids and/or cavities capable of taking in the ink-jet inks of the present invention. As ink is printed on the porous media, the ink can fill the voids and the outermost surface can become dry to the touch in a more expedited manner as compared to traditional or swellable media. Common coatings included silica- and alumina-based coatings. Additionally, such coatings are typically bound together by a polymeric binder, and optionally, can include mordants or ionic binding species that are attractive of classes of predetermined dye species.

"Chroma" refers to the brightness exhibited by the ink-jet ink once printed on the substrate.

"Light fade" refers to a phenomenon of fading of the brightness or chroma, or a hue shift of a printed image over time due primarily to exposure to visible and invisible light frequencies.

"Air fade" refers to a phenomenon of fading of the brightness or chroma, or a hue shift of a printed image over time due to exposure to air contaminants, including ozone and air pollutants, e.g., auto emissions.

"Same polarity" does not mean that two or more components have the same exact charge, e.g., +2 and +2, but merely that individual components have are both negatively charged, or both positively charged.

"Opposite polarity" does not mean that two components have an exact opposite charge, e.g., +2 and −2, but merely that a first individual component is positively charged and a second individual component is negatively charged.

"Surface-charged" or "ionically charged surface" does not imply that only the surface is charged. Surface charged particulates can be charged throughout the particulate, or charged only at or near the surface.

In accordance with one aspect of the present invention, the system provides a substrate 10, and a porous dye-receiving layer 12 deposited on the substrate. The substrate 10 can be paper, plastic, photobase, other known substrate used in the ink-jet printing arts. In some embodiments, photobase can be preferred for use as the substrate. Photobase is typically a three-layered system comprising a single layer of paper sandwiched by two polymeric layers, such as polyethylene layers.

With respect to the porous dye-receiving layer 12, an inorganic semi-metal or metal oxide is typically present. For example, the semi-metal or metal oxide can be silica or alumina. The semi-metal or metal oxide can be bound together by a polymeric binder. Exemplary polymeric binders include polyvinyl alcohol including water-soluble copolymers thereof; polyvinyl acetate; polyvinyl pyrrolidone; modified starches including oxidized and etherified starches; water soluble cellulose derivatives including carboxymethyl cellulose, hydroxyethyl cellulose; polyacrylamide including its derivatives and copolymers; casein; gelatin; soybean protein; silyl-modified polyvinyl alcohol; conjugated diene copolymer latexes including maleic anhydride resin, styrene-butadiene copolymer, and the like; acrylic polymer latexes including polymers and copolymers of acrylic and methacrylic acids, and the like; vinyl polymer latexes including ethylene-vinyl acetate copolymers; functional group-modified latexes including those obtained by modifying the above-mentioned polymers with monomers containing functional groups (e.g. carboxyl, amino, amido, sulfo, etc.); aqueous binders of thermosetting resins including melamine resins, urea resin, and the like; synthetic resin binders including polymethyl methacrylate, polyurethane resin, polyester resin, amide resin, vinyl chloride-vinyl acetate copolymer, polyvinyl butyral, and alkyl resins. Such binder can be present to bind the porous dye-receiving layer together, but can also be present in a small enough amount to maintain the porous nature of the porous dye-receiving layer. Polyvinyl alcohol is a preferred binder for use.

Optionally, the porous dye-receiving layer can also be modified with an ionic binding species or mordant 14 known to interact with a predetermined class of dyes, thereby increasing permanence. Typical mordants that can be used in the dye-receiving layer when the dye is an anionic dye include hydrophilic, water dispersible, or water soluble polymers having cationic groups (amino, tertiary amino, amidoamino, pyridine, imine, and the like). These cationically modified polymers can be compatible with water-soluble or water dispersible binders and have little or no adverse effect on image processing or colors present in the image. Suitable examples of such polymers include, but are not limited to, polyquaternary ammonium salts, cationic polyamines, polyamidins, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin.

Coated on top of the porous dye-receiving layer 14 is a porous ionic layer 16. The porous ionic layer 16 comprises multiple particulates that have commonly ionically-charged surface. An example of such compositions can include grafted chains of anionic polymer. Preferably, the porous ionic layer comprises a crosslinked polymer, though this is not required.

As dyes are typically anionic, anionic surface-charged polymeric compositions are preferred for use in the porous ionic layer. Typical examples of particulates that can be used in the porous ionic layer include core-shell composite copolymers, or copolymers that are water insoluble at a neutral pH, and can be solubilized at basic pH levels of pH 8 and above, though pH 8 to 10.5 is preferred. With respect to the core-shell composite copolymers, the copolymers can include a polymeric shell and a polymeric core, wherein the polymeric shell comprises a hydrophilic anionic polymer grafted to the polymeric core. Examples of polymeric shell components can include, in one embodiment, anionic polymers selected from the group consisting of polyacrylates, polymethacrylates, anionically modified starches, polysaccharides, polycarboxylates, polysulfonates, polyphosphonates, and copolymers thereof. In another embodiment, the polymeric shell can be a cationic polymer of a polybase type, such as poly(amine), poly (ethyleneimine), poly(amidoamine), poly (diallyldimethyl ammonium salts), polyquternary ammonium salts, cationic acrylic copolymers, and the like. The polymeric core can be any neutral non-soluble material. With respect to the water insoluble copolymers at neutral pH (and soluble at high pH levels), the particulates can comprise a hydrophobic monomer, and acrylic or methacrylic acid. Examples of hydrophobic monomers that can be used include acrylate esters, methacrylate esters, styrene, and the like. In either embodiment, or other similar embodiments where the surface is ionically charged, preferably, particulates can be crosslinked, though this is not required.

Other optional characteristics to consider when selecting the polymeric particulates of the porous ionic layer 16 can include appropriate glass transition temperature, ultraviolet absorbing capability, and resistance to water or hydrophobicity. The glass transition temperature (Tg) of the polymer particles should be above ambient in order to prevent fusing of the particulates and the media, as such would diminish the desired porosity prior to printing. Further, in some embodiments, it may be desirable for a polymer of the porous ionic layer 16 to possess ultraviolet-absorbing capability. Blocking of ultraviolet radiation can significantly slow light fade of many dyes used in ink-jet printing. Any species capable of absorbing ultraviolet or near-ultraviolet radiation that is transparent to visible light can be used. For example, a composition package comprising benzophenone and/or a hindered amine (HALS) species can be used. If using an ultraviolet absorber with the present invention, the blocking can be selected such that it is soluble in the polymer of the porous ionic layer. Additionally, a polymer can be selected that is, to some degree, water-resistant at neutral and slightly acidic pH levels. This can provide improved water resistance of the finished ink-jet print.

The porous ionic layer may also consist of porous inorganic oxide (silica, alumina) and water-soluble anionic polymer. For example, polyacrylates, polymethacrylates, anionically modified starches, polysaccharides, polycarboxylates, polysulfonates, polyphosphonates and copolymers thereof can be used, provided the composition is different than the dye-receiving layer.

In addition to the above three optional components, in order to keep particulates of the porous ionic layer together, a small amount of the binder can be added to the coating to bind the components together. An example of such a binder that can be used includes poly-vinyl alcohol (PVOH). Additionally, the binders that can be used in ionic layer are similar to those described with respect to the porous dye-receiving layer. The amount of binder used should be high enough to bind particles together, and low enough to avoid blocking of the physical porosity between particles.

The porous dye-receiving layer 12 and the porous ionic layer 16 provide a large number of voids or pores 18*a*, 18*b*, respectively, such that ink-jet ink 20 can pass through the coating upon printing, and be deposited on the porous dye-receiving layer 12. The porous ionic layer 16 comprises particulates 22 having a surface charge 24 of a first polarity "a". The ink-jet ink 20 comprises a dye also having the first polarity "a". Because the polarity of the dye and the polarity of the porous ionic layer are the same (i.e., both positive or both negative), the porous ionic layer 16 does not attract the dye of the ink-jet ink 20, and thus, the ink-jet ink is allowed to substantially pass therethrough and become deposited at the pores 18*a* of the porous dye-receiving layer 12. This is not to say that none of the ink-jet ink remains within the pores 18*b* of the porous ionic layer, as certainly some ink-jet ink will incidentally remain therein.

Once the ink-jet ink 20 substantially penetrates the porous ionic layer 16 and is deposited on the porous dye-receiving layer 12 of the media, the dye 20 can be immobilized on or within the dye-receiving layer by ionic binding species or mordants 14 attached to or homogenously mixed with the porous metal or semi-metal oxide. After deposition of the ink-jet ink, a fluid sealant composition 26, such as present in a solution or dispersion, can be added atop the porous ionic layer. Such a fluid sealant composition 26 can comprise a water-soluble ionic polymer having a charge "b" that is of opposite polarity with respect to the porous ionic layer. For example, if the porous ionic layer comprises particulates with anionic surface properties, i.e., "a" is negative, then the fluid sealant composition can be cationic, i.e., "b" is positive. Conversely, if the porous ionic layer comprises particulates with cationic surface properties, i.e., "a" is positive, then the fluid sealant composition can be anionic, i.e., "b" is negative. The cationic or anionic polymer in fluid sealant solution or dispersion, upon contact with the porous ionic layer (of opposite polarity) will then form an insoluble polyelectrolyte complex (PEC) or interpolymer complex 30, thus protecting the dye from image fade due to light, air, or moisture exposure.

The fluid sealant solution containing fluid sealant composition 26 can be applied to the print surface either through ejection from an ink-jet print head, or directly by more traditional coating processes, e.g., roll-coating. The pore-sealing function of the fluid sealant composition can be enabled through its presence in a fluid. Preferably, the fluid sealant composition 26 will be a water-soluble polymer species with charge opposite that of the porous ionic layer 16. For example, if the porous ionic layer comprises an anionic polymer species, the polymer in the sealant solution can be polycationic. The pH of the sealing solution can be in a range that enables the formation of an insoluble interpolymer complex 30.

If the porous ionic layer is anionic, then typical cationic polymers that can be present as the fluid sealant composition include any cationic polymer species having reasonable solubility in water, and the ability to form an insoluble polymer complex upon interaction with anionic species of the porous ionic layer. The ability to form such an insoluble complex enables pore-sealing, and shielding of the ink-jet ink (and ultimately the dye) from the outside environment. This will improve fade resistance of the printed image. Typical examples of the cationic polymers that can be present in the fluid sealant composition include, but are not limited to, water-soluble polyamines with a vinyl backbone, polyethyleneimine and its derivatives, polyamidoamines, cationic acrylic polymers, cationic homopolymers and copolymers of dialkyldiallyl ammonium salts, cationic acrylic polyquaternary ammonium salts, substituted acrylamide and methacrylamide salts, N-vinylformamide and N-vinylacetamide (both of which can be polymerized and hydrolyzed in alkaline or acidic media to vinylamine copolymers), and salts of N-vinylimidazole, 2-vinylpyridine or 4-vinylpyridine. If the porous ionic layer is cationic, then the fluid sealant composition should be anionic. Typical examples of the anionic polymers that can be present in the fluid sealant composition include, but are not limited to, polyacrylates, polymethacrylates, anionically modified starches and other polysaccharides or polycarboxylates, polysulfonates, polyphosphonates and copolymers of all the above mentioned species. Anionic water-soluble polymers can also be used in both acidic and salt forms, e.g., polyacrylic acid and soluble salts of polyacrylic acid.

The suggested media sheets, systems, and methods of the present invention combine advantages of both porous media and swellable media types, e.g., rapid drying time as with porous media and improved fade resistance as with swellable media. For example, during actual printing, the media behaves more like porous media. Its two porous layers, i.e., porous dye-receiving layer and porous ionic layer, absorb the ink into and through its pores or voids, resulting in the quick dry-time. After the fluid sealant composition is applied to the media surface (either by an ink-jet pen, a roller, or other coating method), the porous ionic layer can become substantially sealed through the formation of an interpolymer complex 30. The sealing of the surface porosity acts to isolate the ink-jet ink and its contained dye within the pores, particularly at or near the porous dye-receiving layer. This results in significantly improved print fade resistance due to air fade and light fade.

With respect to the various dyes of the ink-jet ink 20 that can be used, either a cationic dye or an anionic dye should be used. As anionic dyes are much more prevalent, most embodiments will utilize a porous anionic layer, an anionic dye, and a cationic fluid sealant composition. Examples of dyes that can be used include, but are not limited to Direct Red 9, Direct Red 254, Magenta 377, Acid Yellow 23, Direct Yellow 86, Yellow 104, Direct Yellow 4, Yellow PJY H-3RNA, Direct Yellow 50, Acid Orange 7, Acid Red 249, Direct Blue 199, Direct Black 168, Direct Yellow 132; Aminyl Brilliant Red F-B (Sumitomo Chemical Co.); Reactive Black 31 Direct Yellow 157, Reactive Yellow 37, Reactive Red 180, Acid Red 52), Acid Blue 9); mixtures thereof; and the like. Further examples include Tricon Acid Red 52, Tricon Direct Red 227, and Tricon Acid Yellow 17 (Tricon Colors Incorporated), Bernacid Red 2BMN, Pontamine Brilliant Bond Blue A, BASF X-34, Pontamine, Food Black 2, Reactive Red 4Reactive Red 56, Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red H8B (Reactive Red 31), Procion Red MX 8B GNS, Procion Red G, Procion Yellow MX-8G, Procion Black H-EXL, Procion Black P—N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C8G, Intracron Red C-8B, Intracron Turquoise Blue GE, Intracron Turquoise HA, and Intracron Black RL, all available from Crompton and Knowles, Dyes and Chemicals Division; mixtures thereof, and the like. This list is provided as exemplary, and is not intended to be limiting.

Figure 2:
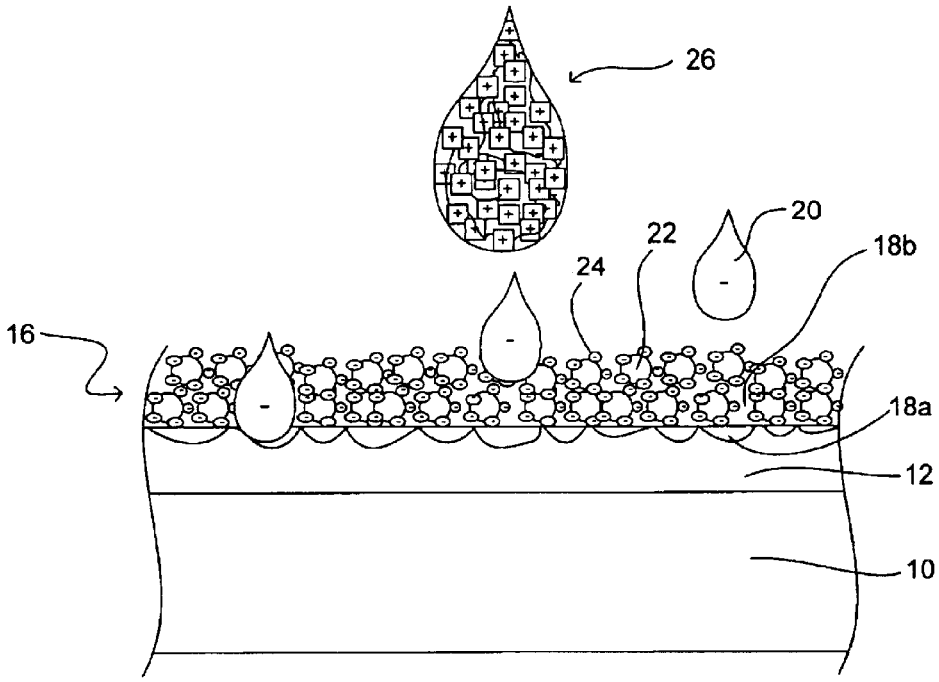
FIG. 2 is a cross-sectional view of a media sheet as used for the system and method in accordance with embodiments of the present invention.
Figure 3:
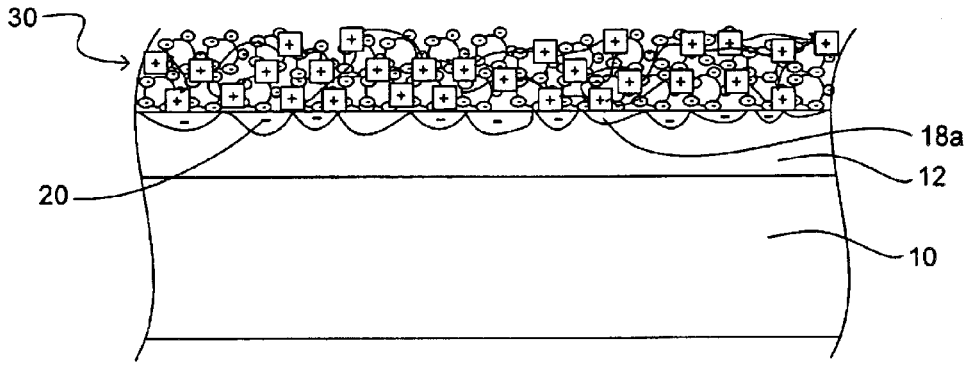
FIG. 3 is a cross-sectional view of a media sheet having an ink-jet ink shielded by an interpolymer complex in accordance with embodiments of the present invention.

Turning to FIGS. 2 and 3, a specific embodiment is provided. Specifically, a substrate 10 is provided, such as a photobase substrate. The substrate is coated with a porous dye-receiving layer 12, such as an alumina or silica based coating bound together by a polymeric binder, and optionally containing ionic binding species and/or mordants. The porous dye-receiving layer 12 provides pores or voids 18*a* at or near the surface. A porous anionic layer 16 is coated on the porous dye-receiving layer. The porous anionic layer 16 comprises a plurality of particulates having negatively-charged surfaces, such as grafted chains of a crosslinked anionic polymer. The porous anionic layer 16 provides pores or voids 18*b* for a negatively charged dye-based ink-jet ink 20 to pass through and become deposited on the porous dye-receiving layer 12. After application of a large portion of the ink-jet ink 20 onto the porous dye-receiving layer 12, a cationic fluid sealant composition can be applied to the surface of the printed media. Upon such application, an interpolymer complex 30 is formed that substantially seals the ink-jet ink and its anionic dye within and beneath the interpolymer complex 30.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following Examples provide further detail in connection with what are presently deemed to be the most practical and preferred embodiments of the invention.

Example 1

Preparation of a porous dye-receiving layer coated substrate

A dye-receiving layer coating composition was prepared by admixing, by weight, 100 parts fumed silica (Aerosil 200 from Degussa), 400 parts of 10% weight solution polyvinyl alcohol (MO56-98 from Clariant), 25 parts of a 20% weight solution of the cationic mordant polydimethyldiallyl ammonium chloride, and 600 parts water. The dye-receiving layer coating composition was applied to a 7-mil resin-coated photobase (from Rexham) by knife casting to a dry coating weight of 25 g/m$^2$.

Example 2

Preparation of a porous dye-receiving layer coating composition

A porous dye-receiving layer coating composition was prepared by admixing, by weight, 100 parts of fumed silica (Aerosil 200" from Degussa), 200 parts of a 10% weight solution polyvinyl alcohol (MO56-98 from Clariant), 200 parts of a 5% weight solution polyacrylic acid (M-90,000), and 600 parts water. The porous dye-receiving layer coating composition was applied to a 7 mil resin-coated photobase (from Rexham) by knife casting to a dry coating weight 15 g/m$^2$.

Example 3

Ink-jet printing and formation of interpolymer complex

To the dye-receiving layer coated photobases of Example 1 and Example 2 was applied a polymeric porous anionic layer, and these media sheets were printed with an anionic dye-based ink-jet ink. After 5 minutes, a 2% weight solution of branched polyethyleneimine (M~60,000–90,000) was sprayed with an airbrush on top of both printed images. An interpolymer complex protected ink-jet ink image was produced in both cases that exhibited good air fade and light fade resistance.

It is to be understood that the above arrangements and Examples are only illustrative of the application for the principles of the present invention. Numerous modifications and alternative arrangements can be devised without departing from the spirit and scope of the present invention. While the present invention has been described by examples and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth in the claims.

What is claimed is:

1. A media sheet, comprising:

a substrate;

a porous dye-receiving layer deposited on the substrate, said porous dye-receiving layer comprising a metal or semi-metal oxide bound by a polymeric binder;

a porous ionic layer deposited on the porous dye-receiving layer, said porous ionic layer comprising polymeric particulates having ionically-charged surfaces;

an ink-jet ink deposited on the porous ionic layer, said ink-jet ink comprising an ink vehicle and a dye, said dye having the same polarity as the ionically-charged surfaces, said ink vehicle being substantially free of components that would substantially react with the ionically-charged surfaces; and a fluid sealant composition deposited on the porous ionic layer forming an interpolymer complex, said fluid sealant comprising a substantially uncrosslinked water soluble or dispersible polymer having an opposite polarity than the ionically-charged surfaces.

2. A media sheet as in claim 1 wherein, prior to deposition of the ink-jet ink and the fluid sealant, the media sheet consists essentially of:

the substrate;

the porous dye-receiving layer deposited on the substrate; and the porous ionic layer deposited on the porous dye-receiving layer.

3. A media sheet as in claim 1, wherein the substrate is photobase.

4. A media sheet as in claim 1, wherein the porous dye-receiving layer further comprises a mordant component configured for fixing a predetermined class of dyes.

5. A media sheet as in claim 1, wherein the metal or semi-metal oxide is silica.

6. A media sheet as in claim 1, wherein the metal or semi-metal oxide is alumina.

7. A media sheet as in claim 1, wherein the particulates are anionically charged at their surfaces.

8. A media sheet as in claim 7, wherein the particulates comprise a polymeric shell and a polymeric core, said polymeric shell comprising a hydrophilic anionic polymer grafted to the polymeric core.

9. A media sheet as in claim 8, wherein the hydrophilic anionic polymer is selected from the group consisting of polyacrylates, polymethacrylates, polysulfonates, anionically modified starches, polysaccharides, polycarboxylates, and polyphosphonates.

10. A media sheet as in claim 7, wherein the particulates are water insoluble at a neutral pH, and are configured to be solubilized in basic conditions from pH 8 to 10.5.

11. A media sheet as in claim 10, wherein the particulates are copolymers of a hydrophobic monomer, and acrylic or methacrylic acid.

12. A media sheet as in claim 7, wherein the particulates comprise crosslinked polymer.

13. A media sheet as in claim 1, wherein the polymeric binder is selected from the group consisting of polyvinyl alcohol, water-soluble copolymers of polyvinyl alcohol, polyvinyl acetate, polyvinyl pyrrolidone, oxidized starches, etherified starches, carboxymethyl cellulose, hydroxyethyl cellulose, polyacrylamide, polyacrylamide derivatives, polyacrylamide copolymers, casein, gelatin, soybean protein, silyl-modified polyvinyl alcohol, maleic anhydride resin, styrene-butadiene copolymer, copolymers of acrylic and methacrylic acids, ethylene-vinyl acetate copolymers, carboxyl-modified latexes, amino-modified latexes, amido-modified latexes, sulfo-modified latexes, melamine resin, urea resin, polymethyl methacrylate, polyurethane resin, polyester resin, amide resin, vinyl chloride-vinyl acetate copolymer, polyvinyl butyral, alkyl resins, and combinations thereof.

14. A system of generating ink-jet images, comprising:

a media sheet comprising a substrate, a porous dye-receiving layer deposited on the substrate, and a porous ionic layer deposited on the porous dye-receiving layer, said porous dye-receiving layer comprising a metal or semi-metal oxide bound by a polymeric binder, said porous ionic layer comprising polymeric particulates having ionically-charged surfaces;

an ink-jet ink comprising an ink vehicle and a dye, said dye having the same polarity as the ionically-charged surfaces, and said ink vehicle being substantially free of components that would substantially react with the ionically-charged surfaces, such that when the ink-jet ink is printed onto the media sheet, ink-jet ink passes through the porous ionic layer and onto the porous dye-receiving layer forming an ink-jet ink-containing media sheet; and a fluid sealant composition comprising a substantially uncrosslinked water soluble or dispersible polymer having an opposite polarity than the ionically-charged surfaces, wherein upon application of the fluid sealant to the ink-jet ink-containing media sheet, an interpolymer complex is formed sealing the ink-jet ink in the media sheet.

15. A system as in claim 14, wherein the ionically-charged surfaces are anionic, the dye is anionic, the ink-vehicle is substantially free of high molecular weight cationic components, and the fluid sealant comprises a water soluble or dispersible cationic polymer.

16. A system as in claim 15, wherein the particulates comprise a polymeric shell and a polymeric core, said polymeric shell comprising a hydrophilic anionic polymer grafted to the polymeric core.

17. A system as in claim 15, wherein the particulates are water insoluble at a neutral pH, and are configured to be solubilized in basic conditions from pH 8 to 10.5.

18. A system as in claim 14, wherein the ionically-charged surfaces are cationic, the dye is cationic, the ink-vehicle is substantially free of high molecular weight anionic components, and the fluid sealant comprises a water soluble or dispersible anionic polymer.

19. A system as in claim 14, wherein the porous dye-receiving layer further comprises a mordant component configured for fixing a predetermined class of dyes.

20. A system as in claim 14, wherein the metal or semi-metal oxide is selected from the group consisting of silica and alumina.

21. A method of ink-jet recording, comprising:

providing a media sheet comprising a substrate, a porous dye-receiving layer deposited on the substrate, and a porous ionic layer deposited on the porous dye-receiving layer, said porous dye-receiving layer comprising a metal or semi-metal oxide bound by a polymeric binder, said porous ionic layer comprising polymeric particulates having ionically-charged surfaces;

ink-jet printing an ink-jet ink onto the media sheet, said ink-jet ink comprising an ink vehicle and a dye, said dye having the same polarity as the ionically-charged surfaces, and said ink vehicle being substantially free of components that would substantially react with the ionically-charged surfaces, thereby forming an ink-jet ink-containing media sheet; and sealing the inkjet ink-containing media sheet with a fluid sealant composition comprising a substantially uncrosslinked water soluble or dispersible polymer having an opposite polarity as the ionically-charged surfaces, wherein upon application of the fluid sealant to the inkjet ink-containing media sheet, an interpolymer complex is formed sealing the ink-jet ink in the media sheet.

22. A method as in claim 21, wherein the ionically-charged surfaces are anionic, the dye is anionic, the ink-vehicle is substantially free of high molecular weight cationic components, and the fluid sealant comprises a water soluble or dispersible cationic polymer.

23. A method as in claim 22, wherein the particulates comprise a polymeric shell and a polymeric core, said polymeric shell comprising a hydrophilic anionic polymer grafted to the polymeric core.

24. A method as in claim 22, wherein the particulates are water insoluble at a neutral pH, and are configured to be solubilized in basic conditions from pH 8 to 10.5.

25. A method as in claim 21, wherein the ionically-charged surfaces are cationic, the dye is cationic, the ink-vehicle is substantially free of high molecular weight anionic components, and the fluid sealant comprises a water soluble or dispersible anionic polymer.

26. A method as in claim 21, wherein the porous dye-receiving layer further comprises a mordant component configured for fixing a predetermined class of dyes.

27. A method as in claim 21, wherein the metal or semi-metal oxide is selected from the group consisting of silica and alumina.

28. A media sheet, comprising;

a substrate;

a porous dye-receiving layer deposited on the substrate, said porous dye-receiving layer comprising a metal or semi-metal oxide bound by a polymeric binder; and a porous ionic layer deposited on the porous dye-receiving layer, said porous ionic layer comprising polymeric particulates having anionically-charged surfaces and having a polymeric shell and a polymeric core, said shell having a hydrophilic anionic polymer grafted to the polymeric core.

29. A media sheet as in claim 28, said media sheet being substantially free of ink-jet ink.

30. A media sheet as in claim 28 consisting essentially of:

the substrate;

the porous dye-receiving layer deposited on the substrate; and the porous ionic layer deposited on the porous dye-receiving layer.

31. A media sheet as in claim 28, wherein the substrate is photobase.

32. A media sheet as in claim 28, wherein the porous dye-receiving layer further comprises a mordant component configured for fixing a predetermined class of dyes.

33. A media sheet as in claim 28, wherein the metal or semi-metal oxide is silica.

34. A media sheet as in claim 28, wherein the metal or semi-metal oxide is alumina.

35. A media sheet as in claim 28, wherein the polymeric binder is selected from the group consisting of polyvinyl alcohol, water-soluble copolymers of polyvinyl alcohol, polyvinyl acetate, polyvinyl pyrrolidone, oxidized starches, etherified starches, carboxymethyl cellulose, hydroxyethyl cellulose, polyacrylamide, polyacrylamide derivatives, polyacrylamide copolymers, casein, gelatin, soybean protein, silyl-modified polyvinyl alcohol, maleic anhydride resin, styrene-butadiene copolymer, copolymers of acrylic and methacrylic acids, ethylene-vinyl acetate copolymers, carboxyl-modified latexes, amino-modified latexes, amido-modified latexes, sulfo-modified latexes, melamine resin, urea resin, polymethyl methacrylate, polyurethane resin, polyester resin, amide resin, vinyl chloride-vinyl acetate copolymer, polyvinyl butyral, alkyl resins, and combinations thereof.

36. A media sheet as in claim 28, wherein the hydrophilic anionic polymer is selected from the group consisting of polyacrylates, polymethacrylates, polysulfonates, anionically modified starches, polysaccharides, polycarboxylates, and polyphosphonates.

37. A media sheet as in claim 28, further comprising an ink-jet ink deposited on the porous ionic layer, said ink-jet ink comprising an ink vehicle and a dye, said dye having the same polarity as the ionically-charged surfaces, said ink vehicle being substantially free of components that would substantially react with the ionically-charged surfaces.

38. A media sheet as in claim 37, further comprising a fluid sealant composition deposited on the porous ionic layer forming an interpolymer complex, said fluid sealant comprising a substantially uncrosslinked water soluble or dispersible polymer having an opposite polarity than the ionically-charged surfaces.

39. A media sheet, comprising;

a substrate;

a porous dye-receiving layer deposited on the substrate, said porous dye-receiving layer comprising a metal or semi-metal oxide bound by a polymeric binder; and a porous ionic layer deposited on the porous dye-receiving layer, said porous ionic layer comprising anionic crosslinked polymeric particulates.

40. A media sheet as in claim 39, said media sheet being substantially free of ink-jet ink.

41. A media sheet as in claim 39 consisting essentially of:

the substrate;

the porous dye-receiving layer deposited on the substrate; and the porous ionic layer deposited on the porous dye-receiving layer.

42. A media sheet as in claim 39, wherein the substrate is photobase.

43. A media sheet as in claim 39, wherein the porous dye-receiving layer further comprises a mordant component configured for fixing a predetermined class of dyes.

44. A media sheet as in claim 39, wherein the metal or semi-metal oxide is silica.

45. A media sheet as in claim 39, wherein the metal or semi-metal oxide is alumina.

46. A media sheet as in claim 39, wherein the polymeric binder is selected from the group consisting of polyvinyl alcohol, water-soluble copolymers of polyvinyl alcohol, polyvinyl acetate, polyvinyl pyrrolidone, oxidized starches, etherified starches, carboxymethyl cellulose, hydroxyethyl cellulose, polyacrylamide, polyacrylamide derivatives, polyacrylamide copolymers, casein, gelatin, soybean protein, silyl-modified polyvinyl alcohol, maleic anhydride resin, styrene-butadiene copolymer, copolymers of acrylic and methacrylic acids, ethylene-vinyl acetate copolymers, carboxyl-modified latexes, amino-modified latexes, amido-modified latexes, sulfo-modified latexes, melamine resin, urea resin, polymethyl methacrylate, polyurethane resin, polyester resin, amide resin, vinyl chloride-vinyl acetate copolymer, polyvinyl butyral, alkyl resins, and combinations thereof.

47. A media sheet as in claim 39, further comprising an ink-jet ink deposited on the porous ionic layer, said ink-jet ink comprising an ink vehicle and a dye, said dye having the same polarity as the ionically-charged surfaces, said ink vehicle being substantially free of components that would substantially react with the ionically-charged surfaces.

48. A media sheet as in claim 47, further comprising a fluid sealant composition deposited on the porous ionic layer forming an interpolymer complex, said fluid sealant comprising a substantially uncrosslinked water soluble or dispersible polymer having an opposite polarity than the ionically-charged surfaces.

* * * * *

UNITED STATES PATENT AND TRADEMARK OFFICE

CERTIFICATE OF CORRECTION

PATENT NO. : 6,833,169 B2
DATED : December 21, 2004
INVENTOR(S) : Kasperchik et al.

It is certified that error appears in the above-identified patent and that said Letters Patent is hereby corrected as shown below:

Column 12,
Lines 15 and 61, before "particulates", insert -- polymeric --.

Signed and Sealed this

Twenty-eighth Day of June, 2005

JON W. DUDAS
*Director of the United States Patent and Trademark Office*